US010651573B2

(12) United States Patent
Washio et al.

(10) Patent No.: US 10,651,573 B2
(45) Date of Patent: May 12, 2020

(54) CONNECTOR WITH TERMINALS THAT ARE CONNECTABLE TO PARALLEL CONDUCTORS OF A WIRING MATERIAL TO FORM AN ELECTRICAL CONNECTION ASSEMBLY

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kazuhiro Washio, Mie (JP); Yasuo Omori, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/316,483

(22) PCT Filed: Jun. 22, 2017

(86) PCT No.: PCT/JP2017/022974

§ 371 (c)(1),
(2) Date: Jan. 9, 2019

(87) PCT Pub. No.: WO2018/012236

PCT Pub. Date: Jan. 18, 2018

(65) Prior Publication Data

US 2019/0252804 A1 Aug. 15, 2019

(30) Foreign Application Priority Data

Jul. 12, 2016 (JP) ..... 2016-137253

(51) Int. Cl.
*H01R 9/03* (2006.01)
*H01R 4/02* (2006.01)
(Continued)

(52) U.S. Cl.
CPC ..... *H01R 9/03* (2013.01); *H01R 4/023* (2013.01); *H01R 4/024* (2013.01);
(Continued)

(58) Field of Classification Search
CPC ..... H01R 9/03; H01R 4/024
(Continued)

(56) References Cited

U.S. PATENT DOCUMENTS 7,258,567 B2 * 8/2007 Tanaka ..... H01R 12/707 439/355
7,973,239 B2 * 7/2011 Koyama ..... H01R 9/0506 174/74 R (Continued)

FOREIGN PATENT DOCUMENTS

| | | |
|---|---|---|
| JP | 2010-146939 | 7/2010 |
| JP | 2014-209437 | 11/2014 |
| JP | 2016-48603 | 4/2016 |

OTHER PUBLICATIONS

International Search Report dated Sep. 12, 2017.

*Primary Examiner* — Abdullah A Riyami
*Assistant Examiner* — Nader J Alhawamdeh
(74) *Attorney, Agent, or Firm* — Gerald E. Hespos; Michael J. Porco; Matthew T. Hespos

(57) ABSTRACT

An electrical connection assembly includes a connector (CN) and a wiring material with conductors. The connector (CN) includes terminals (20) and an insulating housing (30) having a terminal holding portion (32) for holding the wiring material (10) such that the conductors are connected to the respective terminals (20). Each terminal (20) includes a held portion (22) and an outward projecting portion (24) projecting out from a surface (32*a*) of the terminal holding portion (32). The outward projecting portion (24) includes a first projecting portion (26) projecting in a first direction and a second projecting portion (27) extending from the first
(Continued)

projecting portion (26) in a second direction closer to a direction parallel to the surface of the terminal holding portion (32) than the first direction. An outer surface of the second projecting portion (27) has a conductor connection surface (27*a*) connectable to the conductor extending in the second direction.

7 Claims, 16 Drawing Sheets

(51) Int. Cl.
*H01R 43/02* (2006.01)
*H01R 13/506* (2006.01)

(52) U.S. Cl.
CPC ..... *H01R 43/0249* (2013.01); *H01R 13/506* (2013.01); *H01R 2201/26* (2013.01)

(58) Field of Classification Search
USPC ..... 439/694
See application file for complete search history.

(56) References Cited

U.S. PATENT DOCUMENTS

2011/0034084 A1* 2/2011 Hsueh ..... H01R 9/03 439/630
2014/0295708 A1* 10/2014 Omori ..... H01R 13/422 439/626

* cited by examiner

CONNECTOR WITH TERMINALS THAT ARE CONNECTABLE TO PARALLEL CONDUCTORS OF A WIRING MATERIAL TO FORM AN ELECTRICAL CONNECTION ASSEMBLY

BACKGROUND

Field of the Invention

The invention relates to an electrical connection assembly used in an automotive vehicle or the like and a connector used therefor.

Related Art

A wiring material used in an automotive vehicle or the like includes a flat material in which conductors are arrayed in a specific direction perpendicular to an axial direction of the conductors. The conductors included in the wiring material are connected to terminals of a connector so that the conductors of the wiring material then can be connected to other conductors.

Japanese Unexamined Patent Publication No. 2010-146939 discloses a connector and an assembly to be connected by soldering to a wiring material as described above. This connector includes terminals in the form of thin plates respectively corresponding to wires and a housing for holding the terminals. The housing has a flat terminal array surface and holds the terminals such that the terminals are exposed on the terminal array surface. On the other hand, an insulation coating is removed in advance at an end of each of the wires to expose a conductor, and the wires are held in parts near tips of the conductors so that the tips of the conductors are aligned in a row.

Cream solder is set on surfaces of the terminals in advance, and the tips of the conductors and the surfaces of the terminals are soldered by pressing the cream solder against the surfaces of the terminals and heating the cream solder by a heater with the tips of the respective conductors of the wires positioned on the cream solder.

However, in the above connector and in an electrical connection assembly provided therewith, the surfaces of the terminals are arranged in a direction parallel to an array direction while being exposed on the flat terminal array surface of the insulating housing. Thus, if intervals between the terminals adjacent to each other are made smaller, a short circuit may occur between the wires or the terminals via the solder for connection on the terminal array surface. In other words, large intervals between the terminals adjacent to each other needs to be set to avoid such a short circuit. This becomes a major obstacle to a width reduction of the entire electrical connection assembly.

The invention aims to provide a connector constituting an electrical connection assembly by being connected to a wiring material including conductors and to enable a width reduction of the electrical connection assembly while avoiding a short circuit between terminals or the conductors adjacent to each other.

SUMMARY

The invention relates to a connector that can be connected to a wiring material to form an electrical connection assembly. The wiring material includes conductors. The connector includes terminals respectively corresponding to the conductors of the wiring material. The connector also includes an insulating housing having a terminal holding portion for collectively holding the terminals arrayed in an array direction perpendicular to a longitudinal direction of the conductors to enable the conductors to be connected conductively to the terminals while being arranged at intervals in the array direction. Each of the terminals includes a held portion to be held in the insulating housing and an outward projecting portion projecting outwardly of a surface of the terminal holding portion from the held portion. The outward projecting portion of each of the terminals has a bent shape to include a first projecting portion projecting integrally in a first direction from the surface of the terminal holding portion and a second projecting portion extending from the first projecting portion in a second direction closer to a direction parallel to the surface of the terminal holding portion than the first direction. Additionally, an outer side surface on a side opposite to the surface of the terminal holding portion has a conductor connection surface shaped to be connectable to the conductor of the wiring material with the wiring material extending in the second direction. The terminal holding portion holds the held portions of the terminals such that the conductor connection surfaces of the terminals are arranged at intervals in the array direction.

The invention also relates an electrical connection assembly with a wiring material including conductors and the above connector. The conductors extend along the second direction and are connected to the respective conductor connection surfaces of the terminals while being arranged at intervals in the array direction perpendicular to the second direction.

DETAILED DESCRIPTION

FIGS. 1 to 10 show an electrical connection assembly according to a first embodiment of the invention and a manufacturing method therefor. The electrical connection assembly includes wires 10 and a connector CN for connecting the wires 10 to another connector.

Figure 6:
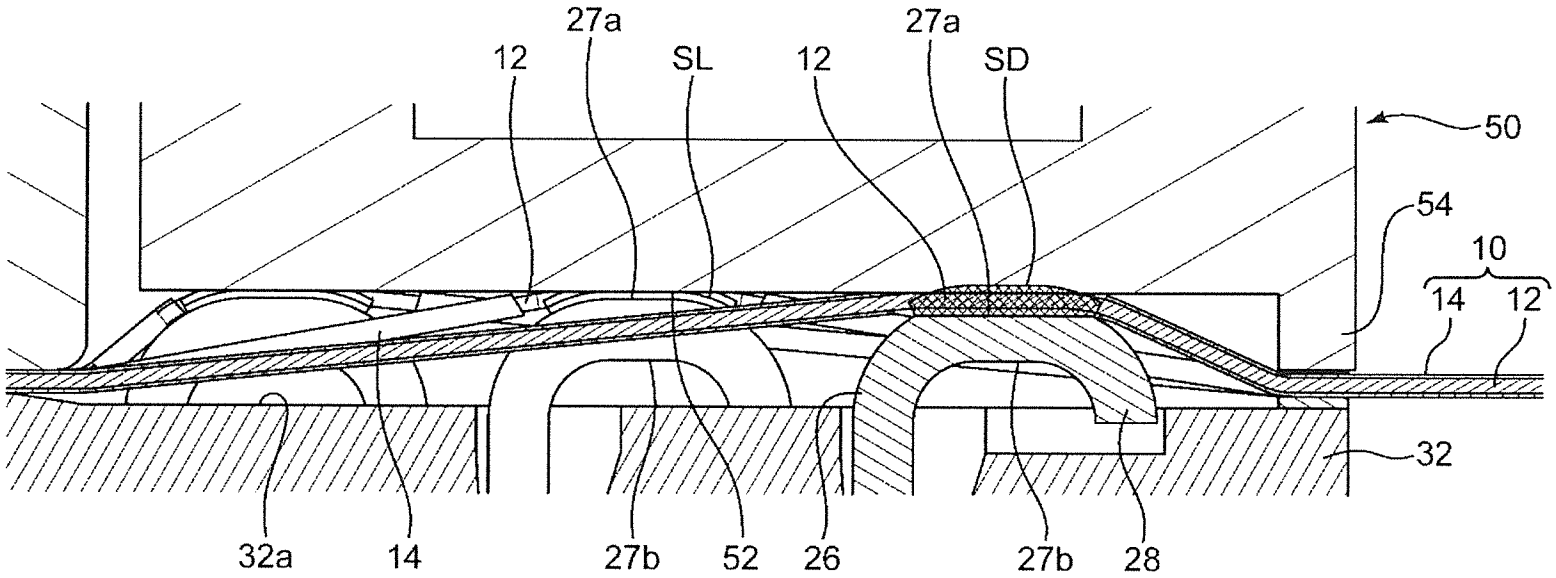
FIG. 6 is an enlarged view of an area enclosed by a frame line VI in FIG. 5.
Figure 7:
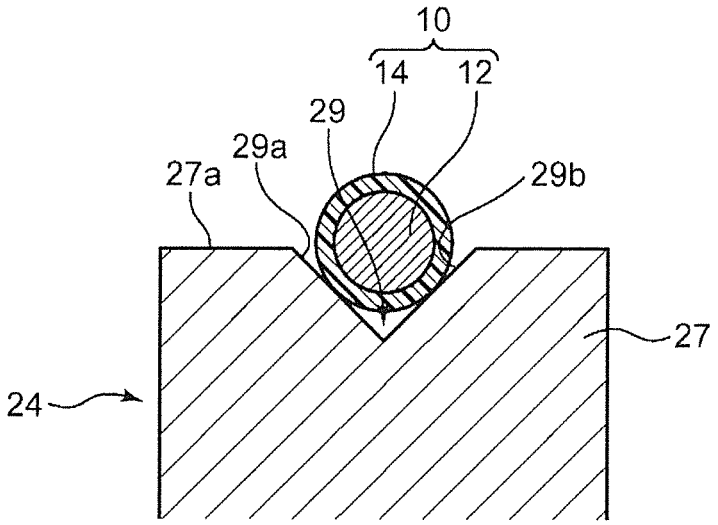
FIG. 7 is a front view in section showing a state where the wire is set in a recessed groove of the terminal.
Figure 8:
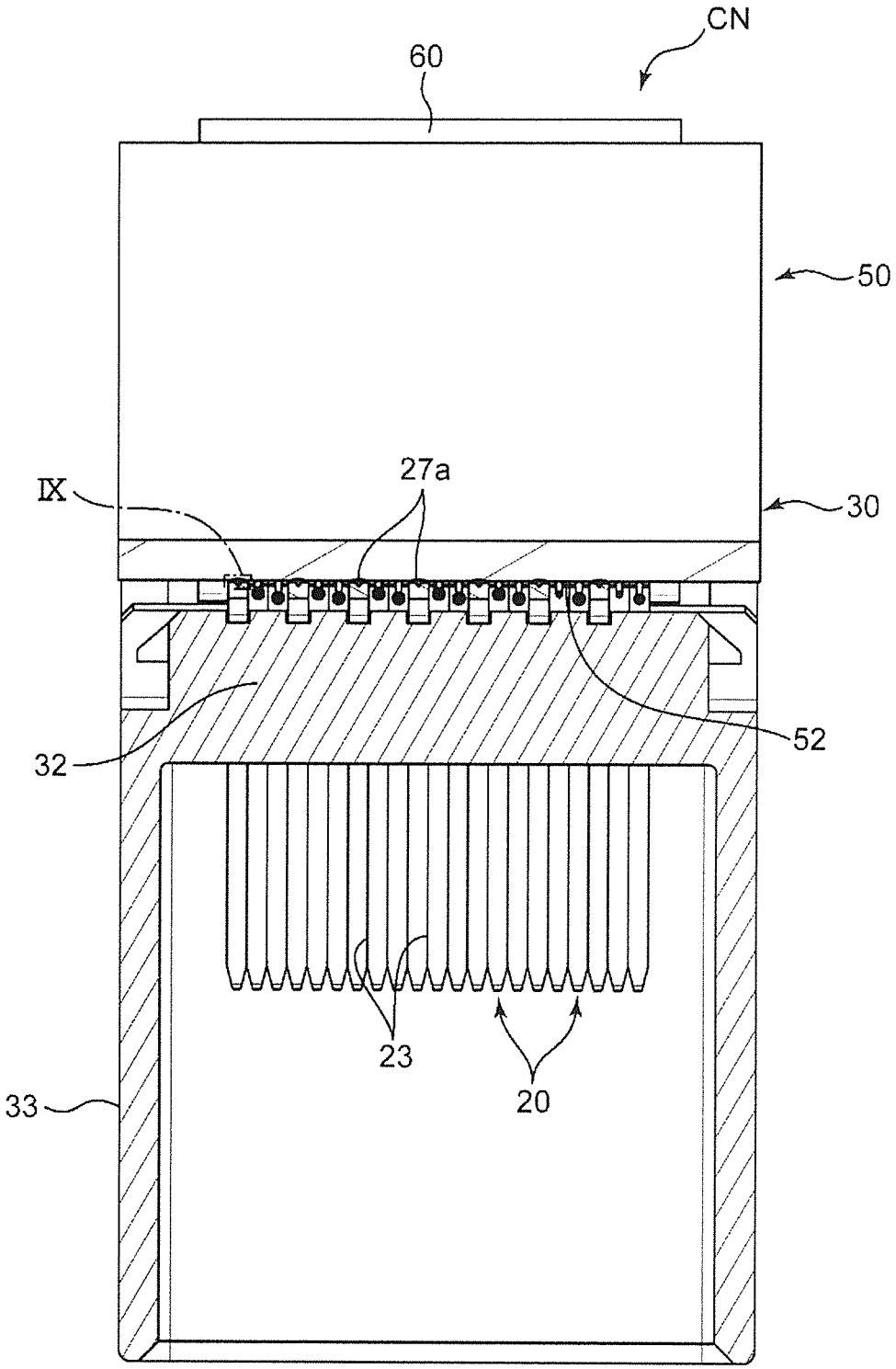
FIG. 8 is a front view in section showing the step shown in FIG. 4.
Figure 9:
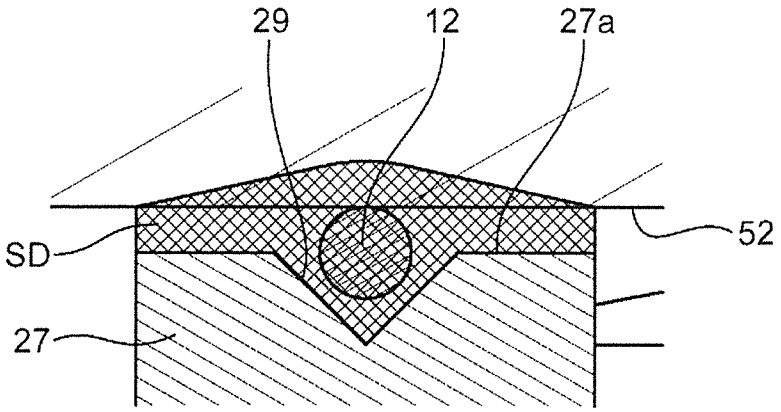
FIG. 9 is an enlarged view of an area enclosed by a frame line IX in FIG. 8.

Each of the wires 10 includes a conductor 12 and an insulation coating 14 for covering the conductor 12, as shown in FIGS. 6 and 7. The wires 10 are connected to the connector CN while being arranged at intervals in parallel to each other in an array direction perpendicular to a longitudinal direction thereof.

The connector CN includes terminals 20 respectively corresponding to the wires 10 and an insulating housing 30 for collectively holding the terminals 20.

Figure 5:
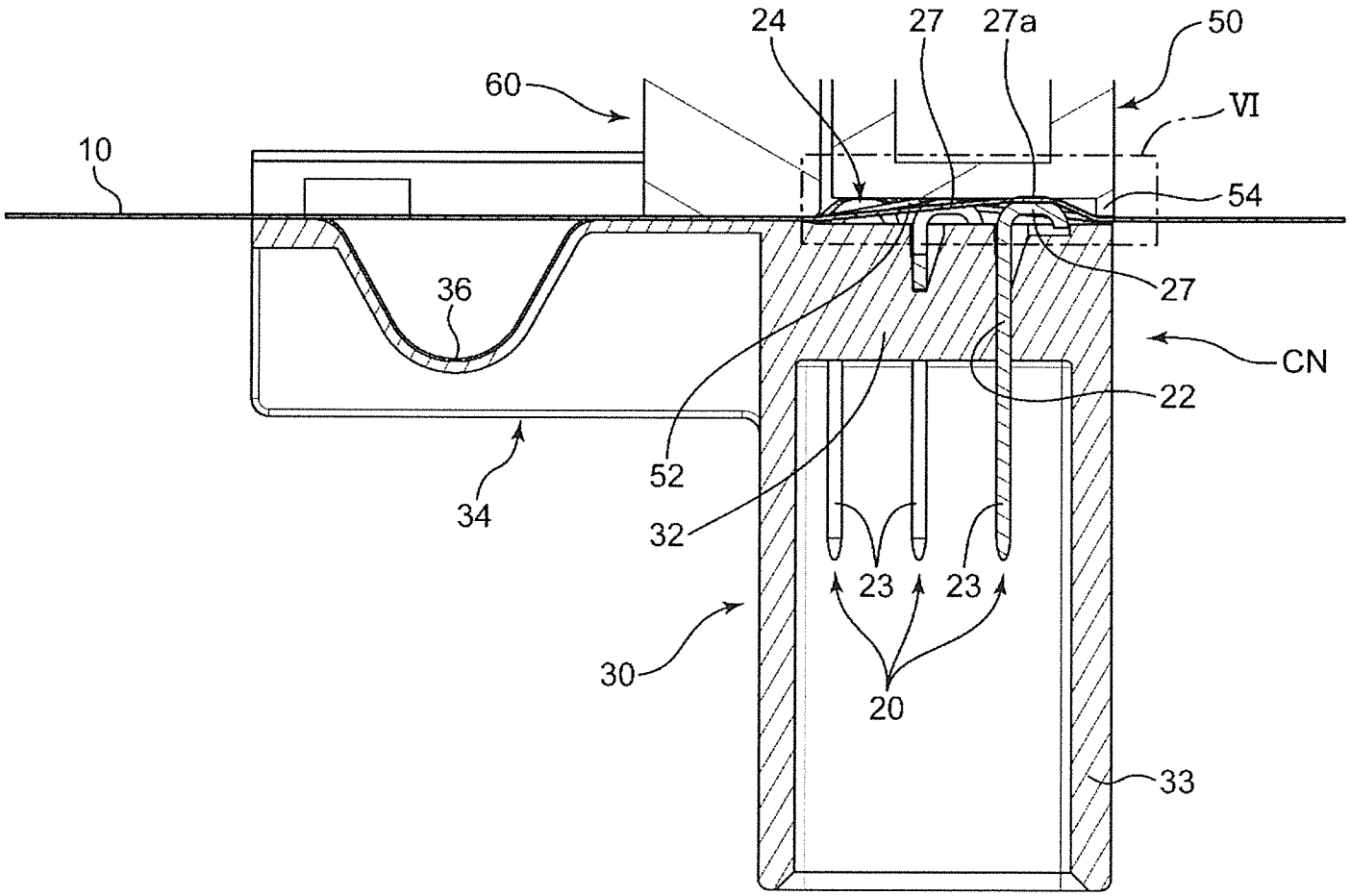
FIG. 5 is a side view in section showing the step shown in FIG. 4.

Each of the terminals 20 according to this embodiment is a male terminal formed of a single long metal plate and includes a held portion 22, an electrical contact portion 23 and an outward projecting portion 24, as shown in FIG. 5. The held portion 22 is to be held in the insulating housing 30, as described later. The electrical contact portion 23 is a male contact portion in this embodiment and is shaped to fit into a female contact portion of a mating terminal. Specifically, the electrical contact portion 23 is shaped to extend straight in a first direction to be described later from the held portion 22. The outward projecting portion 24 projects from the held portion 22 toward a side opposite to the electrical contact portion 23 and is to be connected to the corresponding wire 10. The outward projecting portion 24 is described in detail later.

The insulating housing 30 is molded of an insulating material such as synthetic resin and integrally includes a terminal holding portion 32, a receptacle 33 and a wire holding portion 34.

The terminal holding portion 32 holds the held portion 22 of each of the terminals 20, and is in the form of a block in this embodiment. The terminal holding portion 32 collectively holds the terminals 20 arrayed in the array direction to enable the wires 10 arranged at intervals in the array direction to be connected conductively to the outward projecting portions 24 of the respective terminals 20.

The terminal holding portion 32 holds the held portions 22 of the terminals 20 with the respective terminals 20 penetrating through the terminal holding portions 32 in a direction parallel to the first direction. The first direction is a direction perpendicular to both a longitudinal direction of the wires 10 and the array direction with the wires 10 connected to the terminals 20, and an upward direction in an orientation shown in FIG. 5. That is, parts of the terminals 20 including the held portions 22 penetrate through the terminal holding portion 32 in a vertical direction in the orientation shown in FIG. 5. The held portions 22 may be fixed to the terminal holding portion 32 by being press-fit into through holes provided in the terminal holding portion 32 or by adhesive or the like.

The electrical contact portion 23 of each terminal 20 extends in a direction (down in FIG. 5) opposite to the first direction from the held portion 22 with the held portion 22 held in the terminal holding portion 32 as described above, and is fit into the female contact portion of the mating terminal in this direction. The receptacle 33 is connected integrally to the terminal holding portion 32 and has a tubular shape to surround the electrical contact portions 23 on an outer side in a direction perpendicular to an axial direction (vertical direction in FIG. 5) of the electrical contact portions 23.

The outward projecting portion 24 of each terminal 20 integrally includes a first projecting portion 26, a second projecting portion 27 and a third projecting portion 28 as shown in FIG. 6. The first projecting portion 26 projects in the first direction (up in FIG. 6) from the upper surface 32*a* in FIG. 6 of the terminal holding portion 32. The second projecting portion 27 extends from the first projecting portion 26 in a second direction (direction parallel to the upper surface 32*a* in this embodiment; lateral direction in FIG. 6) closer to a direction parallel to the surface of the terminal holding portion 32 than the first direction and perpendicular to the array direction. The third projecting portion 28 extends down in FIG. 6 and opposite to the first direction from a right end part in FIG. 6) on a side opposite to the first projecting portion 26.

The first projecting portion 26 has a bent shape to approach from the first direction to the second direction gradually while extending away from the upper surface 32*a* of the terminal holding portion 32. Similarly, the third projecting portion 28 has a bent shape to approach the direction (down in FIG. 6) opposite to the first direction while extending away from the second projecting portion 27.

An outer side surface of the second projecting portion 27 (upper surface in FIG. 6) on a side opposite to the upper surface 32*a* in FIG. 6 of the terminal holding portion 32 constitutes a conductor connection surface 27*a*. The conductor connection surface 27*a* is connectable to a part to be connected, which is a specific part of the conductor 12 of the wire 10, by soldering with the part to be connected placed thereon. The conductor connection surface 27*a* according to this embodiment extends in a direction parallel to the upper surface 32*a* of the terminal holding portion 32.

Further, in the first embodiment, the conductor connection surface 27*a* is formed with a groove 29, as shown in FIG. 7. This groove 29 is a recess extending in the longitudinal direction of the wire 10, and is shaped to restrict a displacement of the wire 10 in the array direction (width direction of the terminal 20; lateral direction in FIG. 7) by receiving the wire 10 fit therein. This groove 29 has two positioning inclined surfaces 29*a*, 29*b* inclined toward each other in a direction parallel to the array direction while extending toward a bottom part of the groove 29.

A projecting dimension of the first projecting portion 26 from the upper surface 32*a* of the terminal holding portion 32 is set to position the second projecting portion 27 such that the second projecting portion 27 extends in the second direction at a position where the surface of the second projecting portion 27 facing the upper surface 32*a* of the terminal holding portion 32, i.e. an inner side surface (lower surface in FIG. 6) 27*b* on a side opposite to the conductor connection surface 27*a*, is separated outward (up in FIG. 6) from the upper surface 32*a* of the terminal holding portion 32.

In the first embodiment, outward projecting dimensions of the respective outward projecting portions 24 from the upper surface 32*a* of the terminal holding portion 32 are equal. That is, the terminal holding portion 32 holds the terminals 20 such that the conductor connection surfaces 27*a* of the respective terminals 20 are arranged on the same plane. As just described, the conductor connection surfaces 27*a* of the terminals 20 according to the first embodiment are equivalent to a planar array of terminals.

Further, the terminal holding portion 32 according to the first embodiment holds the held portions 22 of the terminals 20 such that the conductor connection surfaces 27*a* of the terminals 20 are arranged at intervals in the array direction and, in addition, the conductor connection surfaces 27*a* of the terminals 20 adjacent in the array direction are shifted from each other in the longitudinal direction (vertical direction of FIG. 2) of the wires 10. Specifically, in the array shown in FIG. 2, the outward projecting portions 24 have the conductor connection surface 27*a* arrayed along three rows arranged in a direction parallel to the longitudinal direction of the wires 10 and the positions of the conductor connection surfaces 27*a* of the outward projecting portions 24 arranged in each row are shifted in the array direction with respect to the positions of the conductor connection surfaces 27*a* of the outward projecting portions 24 arranged in the adjacent rows.

The wire holding portion 34 extends parallel to the second direction from the terminal holding portion 32 and holds the wires 10 in such an orientation that the wires 10 extend along the second direction. The wire holding portion 34 according to the first embodiment includes parallel wire holding grooves 34*a* corresponding to the respective wires 10 and supports the respective wires 10 from below with the wires 10 fit in the wire holding grooves 34.

Figure 10:
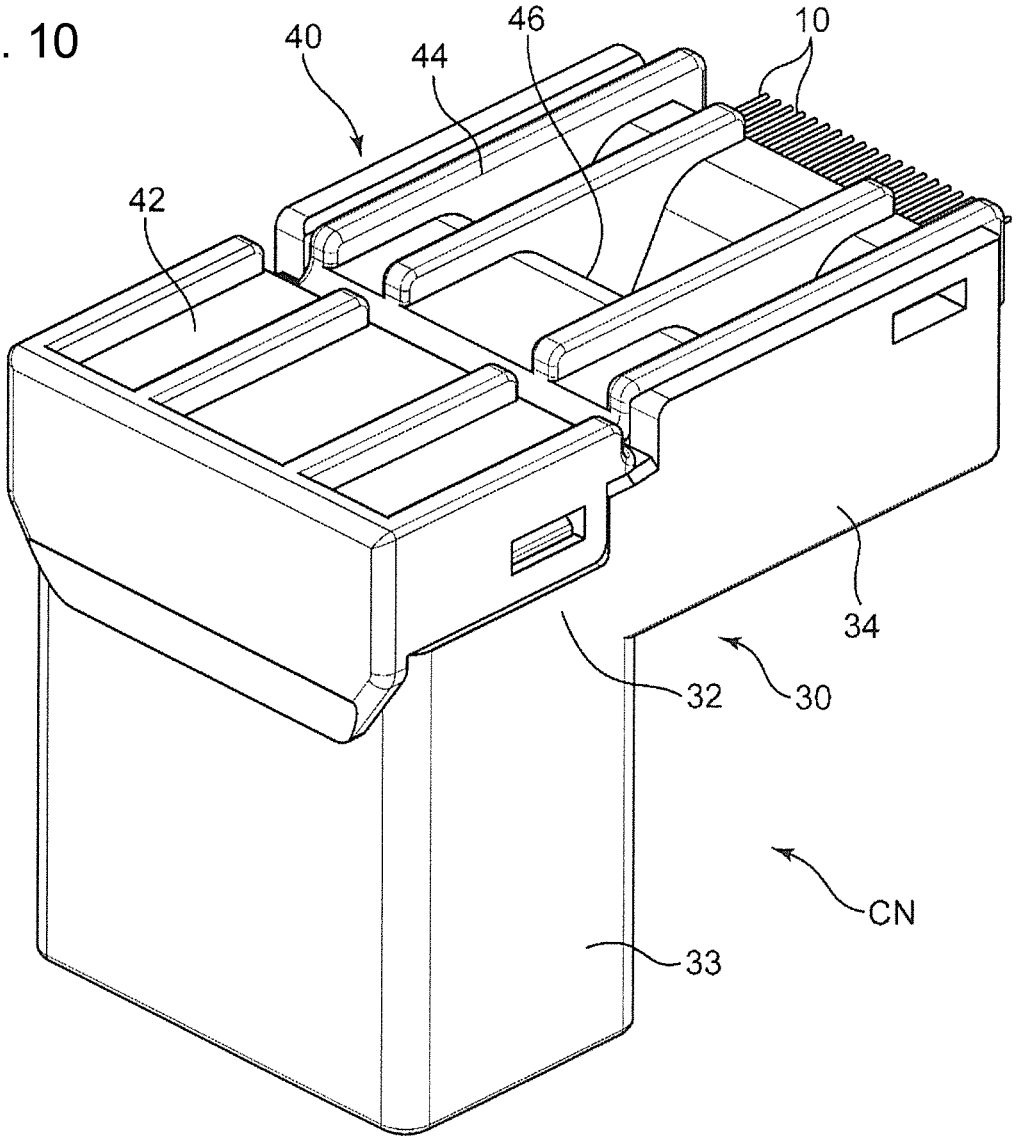
FIG. 10 is a perspective view showing a state where a cover is mounted on an insulating housing of the connector.

The connector CN according to the first embodiment further includes a cover 40, as shown in FIG. 10. The cover 40 is mounted detachably on the insulating housing 30 to cover the outward projecting portions 24 of the terminals 20 and the respective wires 10 connected to the outward projecting portions 24 from above. Specifically, the cover 40 according to the first embodiment integrally includes a terminal cover portion 42 for covering the terminal holding portion 32 and a wire cover portion 44 for covering the wire holding portion 34.

Further, in the wire holding portion 34, the upper surface of the wire holding portion 34, i.e. a surface formed with the wire holding grooves 34*a*, has a curved portion 36 curved to be recessed down at an intermediate position in the second direction, whereas the lower surface of the wire cover portion 44 of the cover 40 has a curved portion 46 bulging down to correspond to the curved portion 36. The curved portions 46, 36 are shaped to restrain intermediate parts of the wires 10 with the intermediate parts curved down, thereby effectively suppressing the action of tension of the wires 10 at connected positions of the parts to be connected of the conductors 12 of the respective wires 10 and the conductor connection surfaces 27*a*.

Note that the wire holding portion 34 and the cover 40 are not essential in the present invention and can be omitted. Conversely, if the parts to be connected of the conductors 12 of the respective wires 10 are provided not near the ends of the wires 10, but at longitudinal intermediate parts, the wire holding portion 34 and the wire cover portion 44 of the cover 40 corresponding thereto may be provided on each of both sides of the terminal holding portion 32 in the longitudinal direction of the wires 10.

Next, a method for manufacturing the electrical connection assembly is described. This electrical connection assembly can be manufactured, for example, by a method including each of the following steps.

1) Wire Preparing Step and Connector Preparing Step

The plurality of wires 10 and the connector CN described above are prepared in advance. Further, in the method according to this embodiment, the plurality of wires 10 prepared include the insulation coatings 14 made of specific synthetic resin. The specific synthetic resin is synthetic resin having an insulating property at normal temperature and, on the other hand, meltable or dissolvable at a melting temperature (e.g. 380 to 400°) of solder used in a connecting step to be described later. Polyurethane, polyester, nylon and the like are preferable as the specific synthetic resin.

A thickness of the insulation coating 14 is preferably set such that the insulation coating 14 can be removed and the conductor 12 can be exposed by heating while an insulating state is ensured at normal temperature. A dimension, for example, approximate to a thickness of an insulation coating in an ordinary enamel wire can be adopted as the thickness.

(2) Solder Setting Step

Solder SD as shown in FIG. 6 is set in advance on the conductor connection surface 27*a* of each of the plurality of terminals 20 in the connector CN. This setting may be performed by placing the solder SD in a solid state on each conductor connection surface 27*a* or applying the solder SD in a paste state to each conductor connection surface 27*a*.

3) Connecting Step

Figure 1:
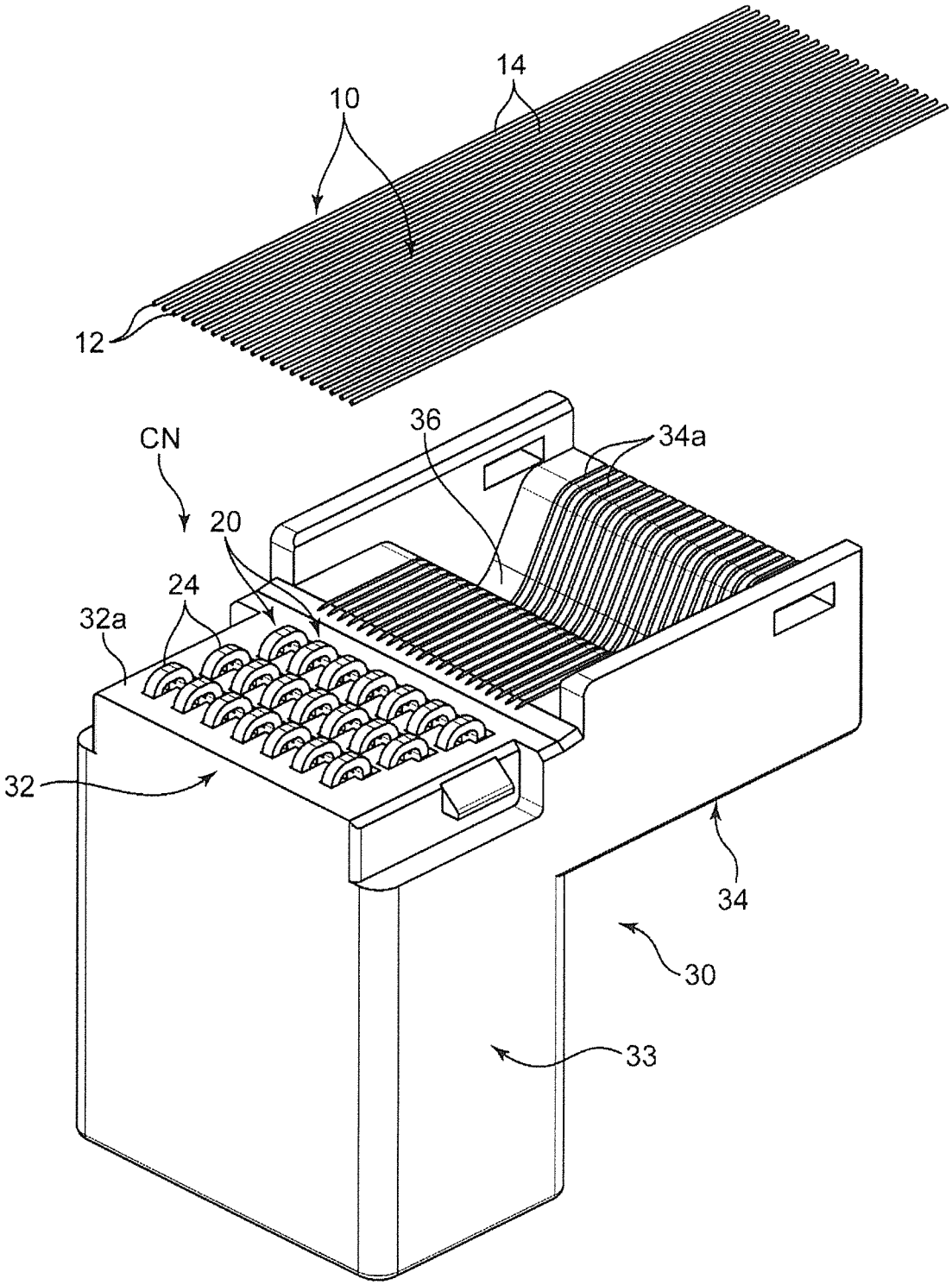
FIG. 1 is an exploded perspective view of an electrical connection assembly according to a first embodiment of the present invention.

The parts to be connected set in longitudinally intermediate areas of the plurality of wires 10 are pressed toward the respective conductor connection surfaces 27*a* of the plurality of terminals 20 with the parts to be connected kept covered by the insulation coatings 14 and the insulation coatings 14 are heated together with the solder SD while the plurality of wires 10 are held in a state arrayed at intervals from each other in the array direction as shown in FIG. 1, whereby the insulation coatings 14 covering the parts to be connected are removed from the surfaces of the conductors 12 by melting or dissolving and the conductors 12 exposed by removing the insulation coatings 14 and the conductor connection surfaces 27*a* are electrically connected by the solder SD.

The plurality of wires 10 are held by holding parts of the wires 10 at positions on both outer sides across the parts to be connected, more preferably at positions outwardly of both ends of the connector CN in a front-rear direction (direction parallel to the second direction and the wire longitudinal direction). In this holding, the wires 10 are preferably set on the corresponding conductor connection surfaces 27*a* while suitable tension is applied to each of the plurality of wires 10. The plurality of wires 10 can be held, for example, by bobbins on which the wires 10 are to be wound, clamping tools for clamping the respective wires 10 from both sides in a direction perpendicular to the longitudinal direction and the array direction of the wires 10 or the like.

Since each conductor connection surface 27*a* is formed with the recessed groove 29 as shown in FIG. 7 in the first embodiment, a part of each wire 10 corresponding to the part to be connected is fit into the recessed groove 29 to be reliably positioned at a suitable position on the conductor connection surface 27*a* (generally a center position in the width direction of the conductor connection surface 27*a*, i.e. in the array direction), thereby restricting an escape from this position in the array direction. Note that the solder SD set on the conductor connection surface 27*a* is not shown in FIG. 7 for the sake of convenience.

The wires 10 can be efficiently pressed against the conductor connection surfaces 27*a* and the insulation coatings 14 of the wires 10 can be heated, using a heater 50 shown in FIGS. 4 to 6, 8 and 9. This heater 50 has a flat lower surface constituting a heating surface 52. The heating surface 52 is pressed against the respective wires 10 set on the respective conductor connection surfaces 27*a* via the solder SD from above. That is, the heating surface 52 is pressed toward the plurality of conductor connection surfaces 27*a* with the plurality of parts to be connected respectively corresponding to the plurality of conductor connection surfaces 27*a* and the solder SD sandwiched between the heating surface 52 and the respective conductor connection surfaces 27*a*. In this way, the pressing of the wires 10 toward the conductor connection surfaces 27*a*, the melting of the solder SD by heating using the heater 52 and the melting or dissolving of the insulation coatings 14 covering the parts to be connected by heating the insulation coatings 14 are simultaneously performed. The melting or dissolving of the insulation coatings 14 enables the insulation coatings 14 to be removed from the surfaces of the conductors 12.

Particularly in the first embodiment, the terminal holding portion 32 of the insulating housing 30 holds the respective terminals 20 such that the respective conductor connection surfaces 27*a* are arranged on the same plane, i.e. the respective terminals 20 constitute the planarly arrayed terminals. Thus, the parts to be connected of the conductors 12 of the respective wires 10 can be simultaneously connected to the conductor connection surfaces 27*a* of the respective terminals 20, which are the planarly arrayed terminals, using the single planar heating surface 52.

In addition, each conductor connection surface 27*a* is provided on the outward projecting portion 24 of each terminal 20 projecting outwardly (upwardly in FIG. 6 and the like) of the terminal holding portion 32 from the upper surface 32*a* of the terminal holding portion 32 and located at the position separated outward from the upper surface 32*a*. Particularly in this embodiment, the conductor connection surface 27*a* is constituted by the outer side surface of the second projecting portion 27 having the inner side surface 27*b* located at a position separated from the upper surface 32*a*. Thus, a short circuit between the terminals 20 and a short circuit between the wires 10 associated with the melting of the solder SD and the melting and removal of the insulation coatings 14 are effectively suppressed. Thus, even if the solder SD is set, for example, in such a manner that the solid solder SD spreads across the plurality of terminals 20, the solder SD is naturally divided for each terminal 20 by the surface tension of the solder SD by being heated as described above, whereby a short circuit via the solder SD is prevented.

Further, the projecting outward projecting portion 24 as described above enables the connecting step to be performed with the wire 10 deformed into an outward convex shape at the outward projecting portion 24 as shown in FIG. 6 by pressing the wire 10 against the surface of the insulating housing 30 (preferably upper surface 32*a* of the terminal holding portion 32) at positions on both sides across the outward projecting portion 24 of the terminal 20. In an example shown in FIGS. 4 to 6, the wires 10 are deformed by the cooperation of a pressing portion 54 provided in advance in the heater 50 and projecting further outward than the heating surface 52 and a pressing member 60 prepared separately from the heater 50.

Such pressing of the wire 10 reliably fixes a relative position of the part to be connected with respect to the conductor connection surface 27*a* and effectively suppresses the removal of the insulation coating 14 in parts other than the part to be connected due to the heating of these parts by the heater 50. In this way, a short circuit between the wires 10 due to the removal of the insulation coatings 14 is effectively suppressed.

Figure 2:
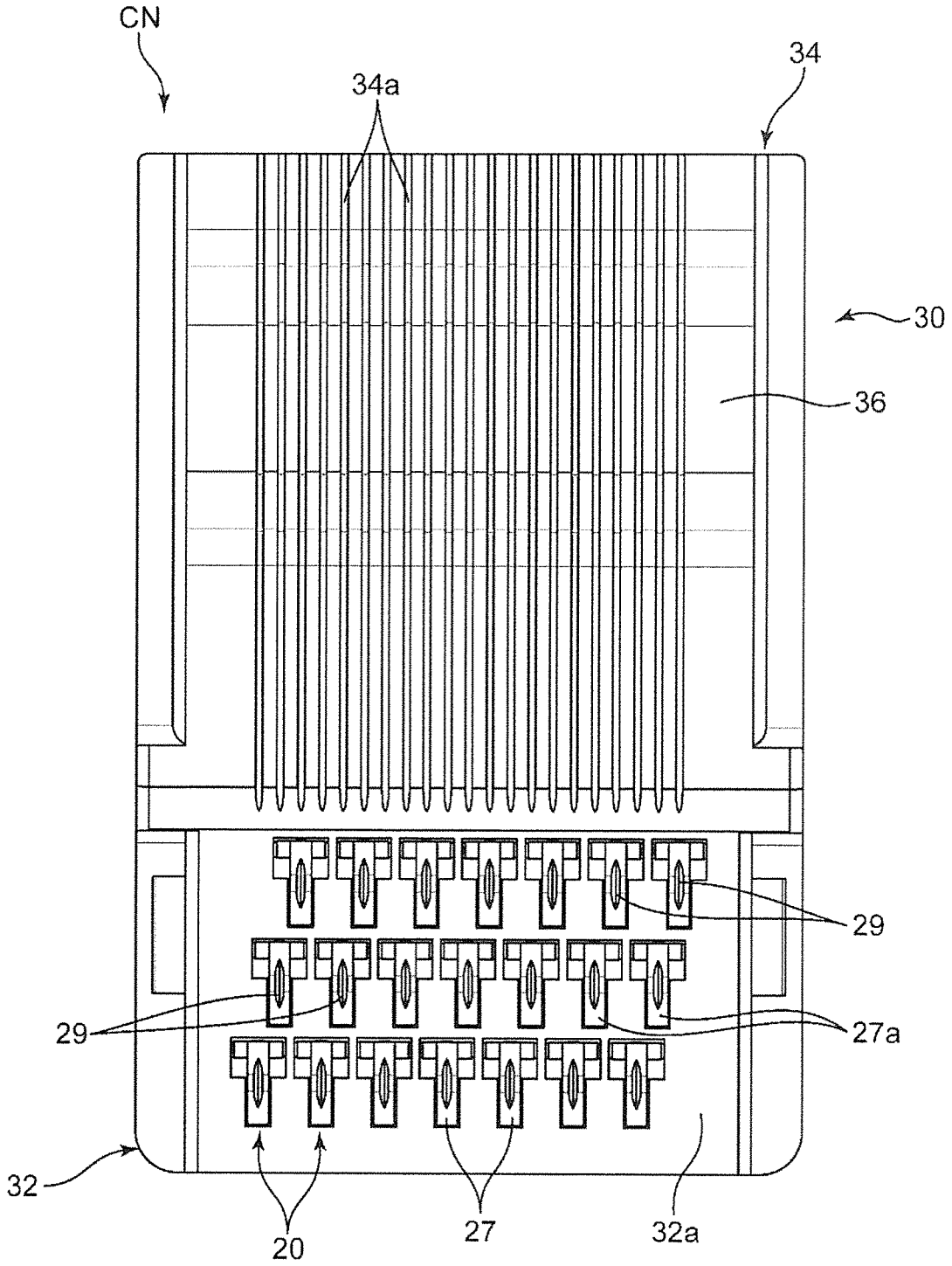
FIG. 2 is a plan view of a connector constituting the electrical connection assembly.
Figure 3:
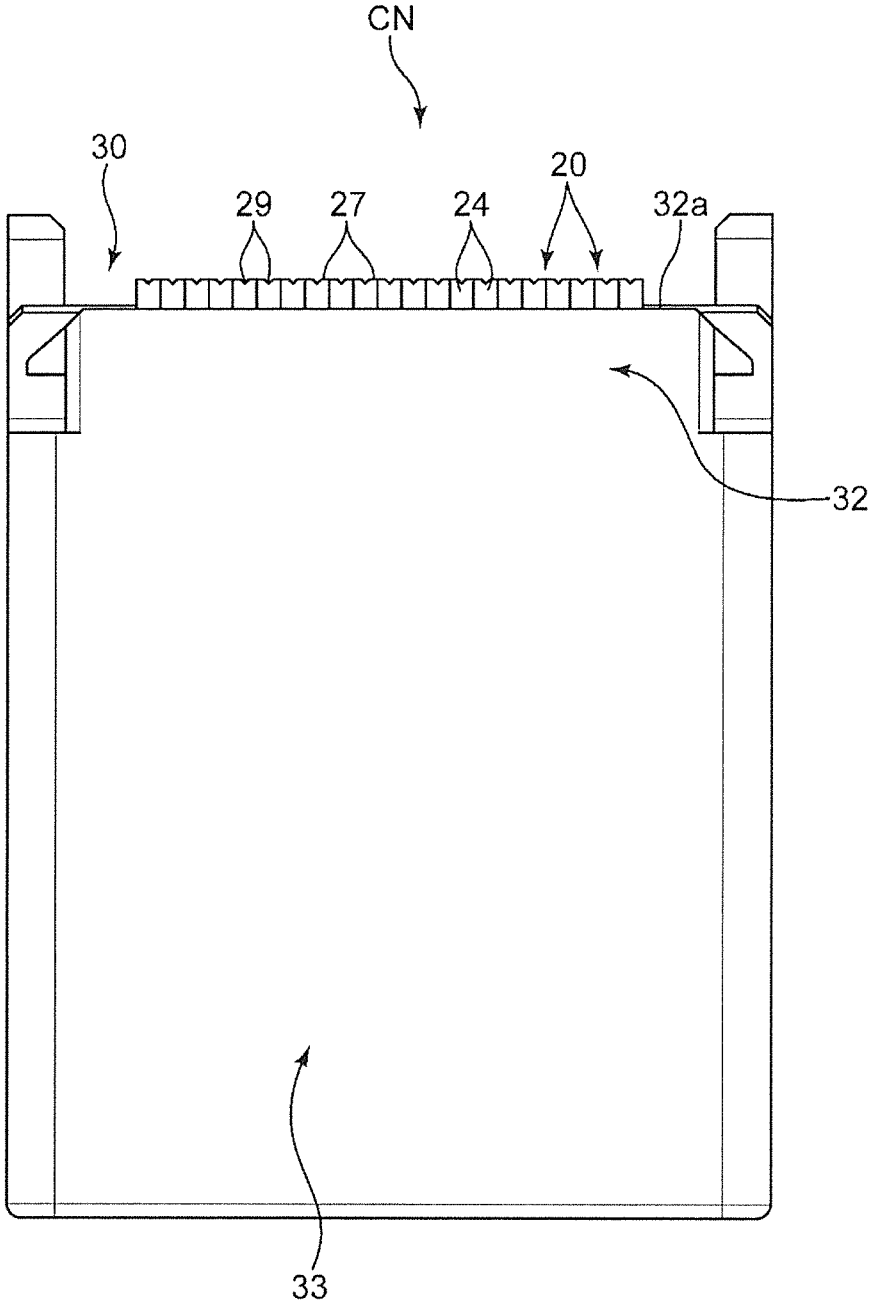
FIG. 3 is a front view of the connector.
Figure 4:
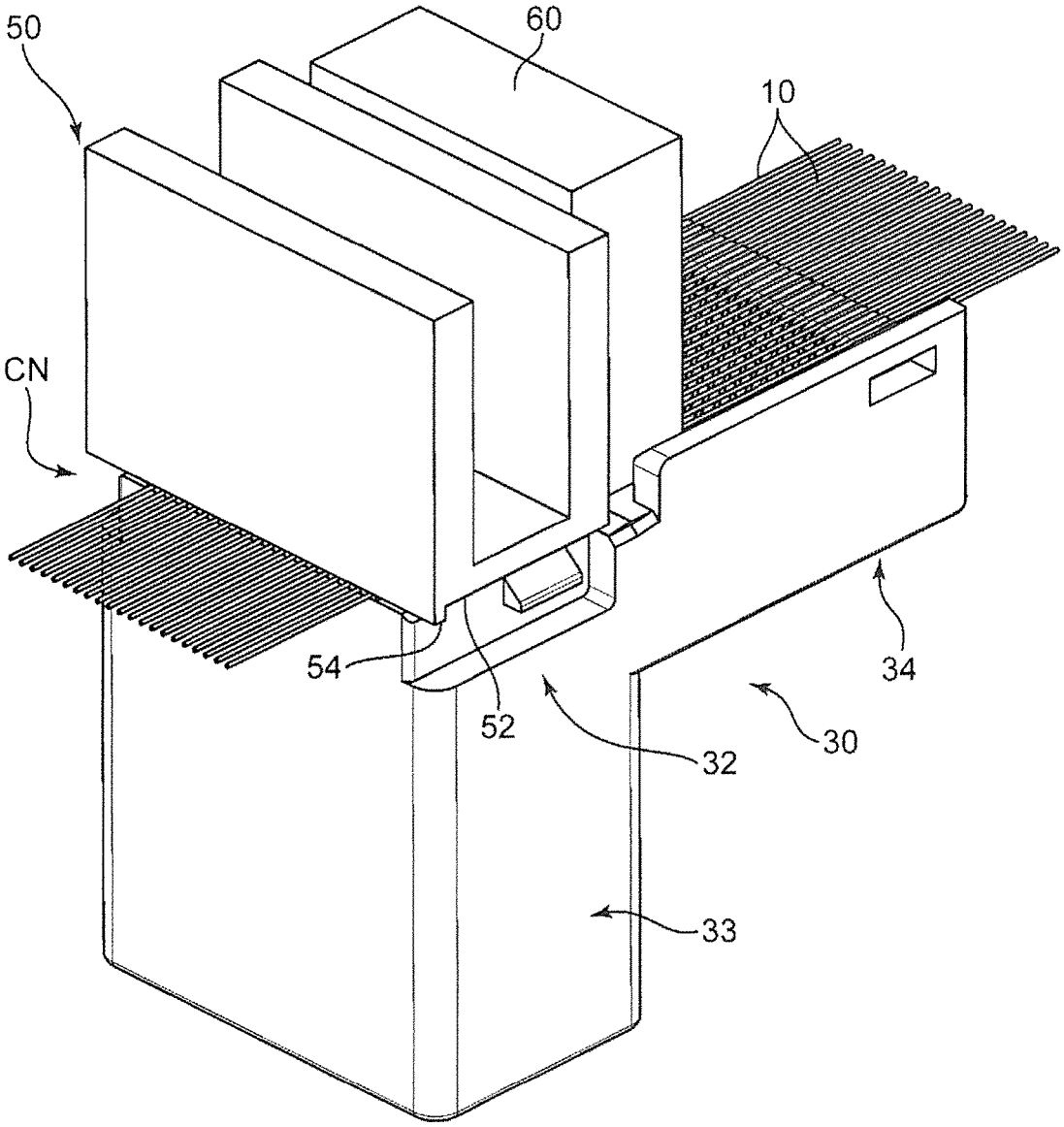
FIG. 4 is a perspective view showing a step of connecting conductor connection surfaces of terminals of the connector and parts to be connected of wires in a method for manufacturing the electrical connection assembly.

Further, the plurality of terminals 20 according to the first embodiment are held in the terminal holding portion 32 such that the conductor connection surfaces 27*a* of the terminals 20 adjacent in the array direction, out of the plurality of terminals 20, are shifted from each other in the longitudinal direction (vertical direction of FIG. 2) of the wires 10 (in the array shown in FIG. 2, the plurality of outward projecting portions 24 each having the conductor connection surface 27*a* are arrayed along three rows arranged in the direction parallel to the longitudinal direction of the wires 10 and the positions of the conductor connection surfaces 27*a* of the outward projecting portions 24 arranged in each row are respectively shifted in the array direction with respect to the positions of the conductor connection surfaces 27*a* of the outward projecting portions 24 arranged in the row(s) adjacent to the former row). In this way, the width of the entire electrical connection assembly can be further reduced by shortening the intervals between the conductor connection surfaces 27*a* in the array direction while providing a large distance (absolute distance in a direction including a component of the longitudinal direction of the wires 10 and a component of the array direction) between the conductor connection surfaces 27*a* adjacent to each other to avoid a short circuit between the conductor connection surfaces 27*a*.

(4) Cutting Step

After the connecting step is completed as described above, the wires 10 are cut at a suitable position in the longitudinal direction thereof The wires 10 can be efficiently cut, for example, by sandwiching and shearing the wires 10 at a suitable cutting position in a direction perpendicular to the longitudinal direction and the array direction of the wires 10 by a pair of cutting tools. The connector CN according to the first embodiment is connected to the ends of the plurality of wires 10. Thus, the respective wires 10 are cut at positions on a side opposite to the wire holding portion 34 across the terminal holding portion 32 (preferably, at positions in immediate vicinity of an outer side surface of the terminal holding portion 32).

By mounting the cover 40 as shown in FIG. 10 if necessary after the cutting step, the electrical connection assembly is completed.

Next, a second embodiment of the present invention is described with reference to FIGS. 11 to 16.

The terminals 20 included in the connector CN according to the first embodiment are all the planarly arrayed terminals. That is, the conductor connection surfaces 27*a* included in the terminals 20 are held side by side on the same plane. On the other hand, a connector CN according to the second embodiment includes first terminals 20A and second terminals 20B having conductor connection surfaces 27*a* at different heights from an upper surface 32*a* of a terminal holding portion 32.

The first and second terminals 20A, 20B are terminals adjacent to each other in a direction parallel to the longitudinal direction of the wires 10. Specifically, in the second embodiment, the terminals 20 arranged in rows on both outer sides in the longitudinal direction out of the terminals 20 arrayed in three rows arranged in the longitudinal direction of the wires 10 as shown in FIG. 1 are directly set as the first terminals 20A, and the second terminals 20B with the conductor connection surfaces 27*a* having a larger height than the terminals 20 arranged in the center row in the longitudinal direction are arranged instead of the terminals 20 in the center row. That is, the conductor connection surfaces 27*a* of the second terminals 20B are at positions higher than the conductor connection surfaces 27*a* of the first terminals 20A (at positions more distant from the upper surface 32*a* of the terminal holding portion 32 in this embodiment).

Also in the second embodiment, a connecting step of heating the solder SD and the respective parts to be connected is performed after a solder setting step is performed as in the first embodiment. In this connecting step, the connection of the first terminals 20A and the wires 10 corresponding thereto and the connection of the second terminals 20B and the wires 10 corresponding thereto are performed in two stages, using a first heater 50A shown in FIGS. 11 to 13 and a second heater 50B shown in FIGS. 14 to 16.

Figure 11:
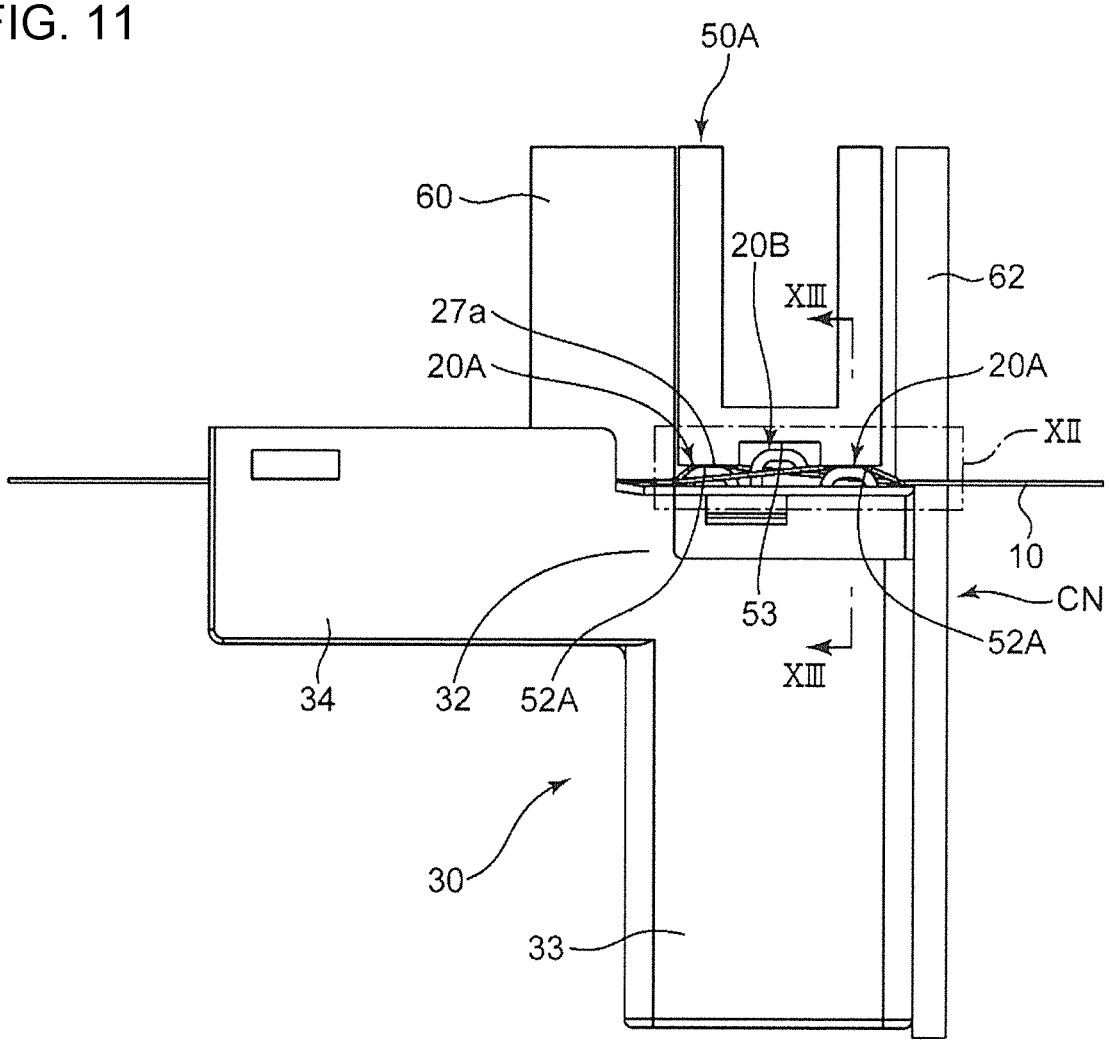
FIG. 11 is a side view showing a step of connecting conductor connection surfaces of first terminals and parts to be connected of wires corresponding thereto in a method for manufacturing an electrical connection assembly according to a second embodiment of the present invention.
Figure 12:
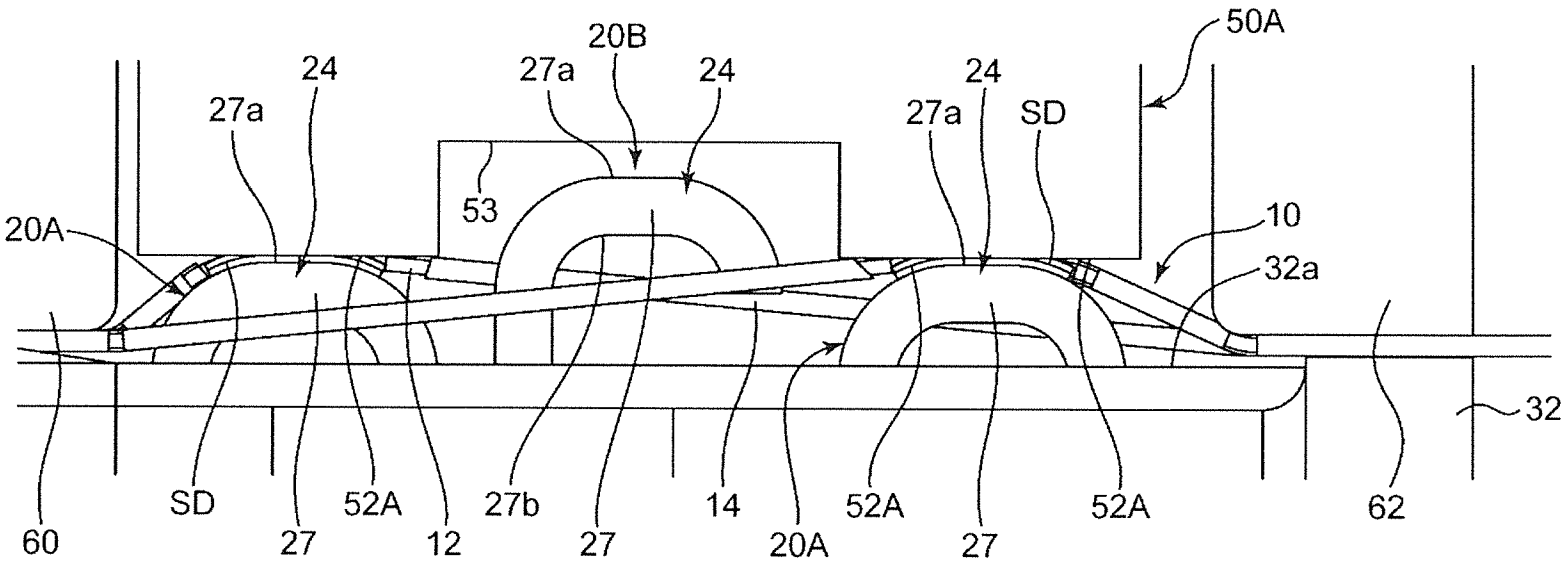
FIG. 12 is an enlarged view of an area enclosed by a frame line XII in FIG. 11.
Figure 13:
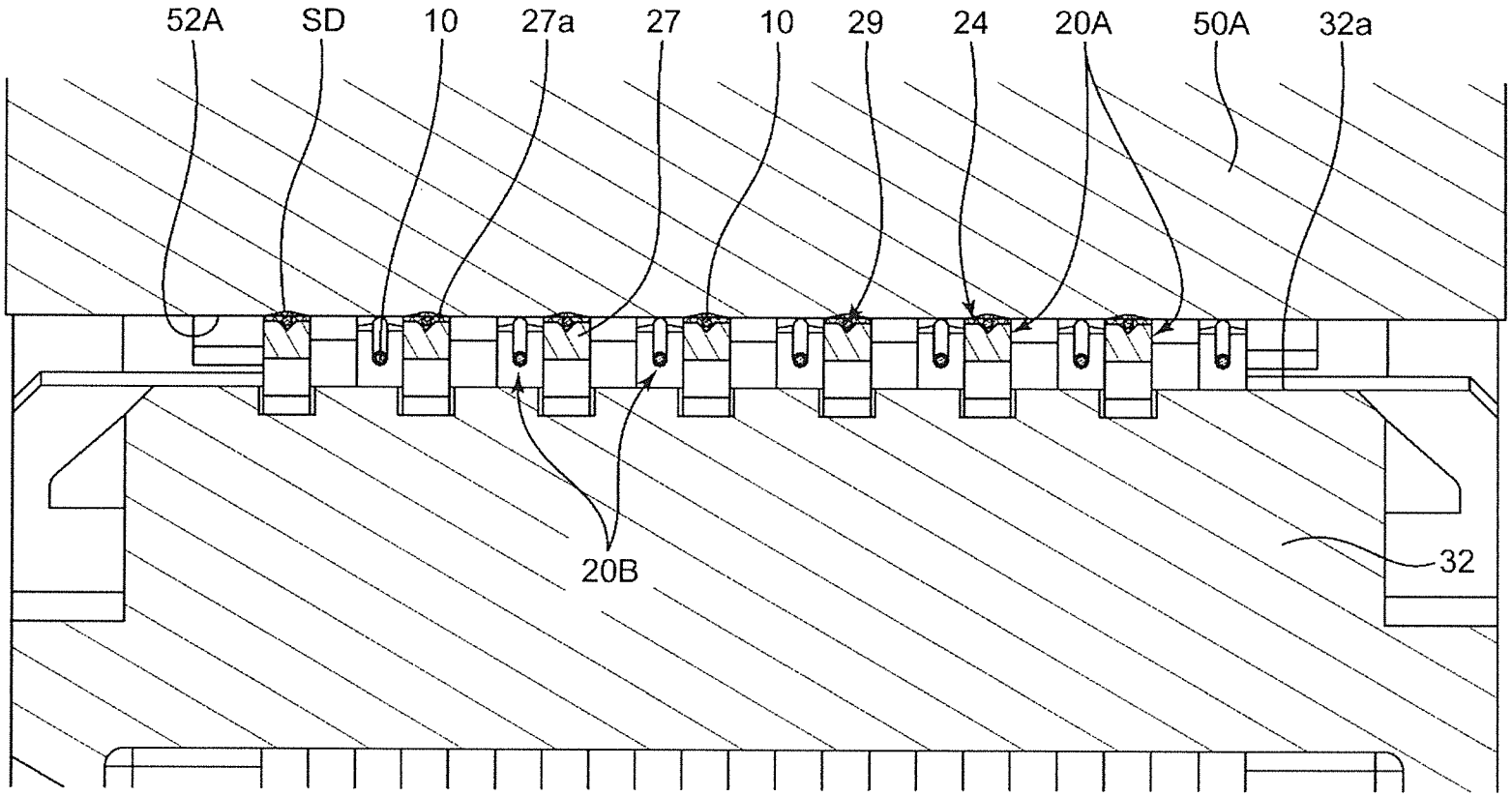
FIG. 13 is a section along XIII-XIII of FIG. 11.

As shown in FIGS. 11 to 13, the first heater 50A includes two first heating surfaces 52A located at positions corresponding to two rows in which the first terminals 20A are arranged, and a part 53 between the first heating surfaces 52A is recessed upward from the first heating surfaces 52A by a dimension sufficient to avoid interference with the second terminals 20B. First, the first heating surfaces 52A of the first heater 50A are pressed against the conductor connection surfaces 27*a* with the respective wires 10 and the solder SD sandwiched between the first heating surfaces 52A and the conductor connection surfaces 27*a* in the respective first terminals 20A, whereby the melting of the solder SD and the removal of the insulation coatings 14 covering the parts to be connected from the surfaces of the conductors 12 by melting or dissolving are simultaneously performed as in the connecting step in the first embodiment. In this way, the conductor connection surfaces 27*a* in the first terminals 20A and the parts to be connected of the corresponding conductors 12 are electrically connected by the solder SD.

Figure 14:
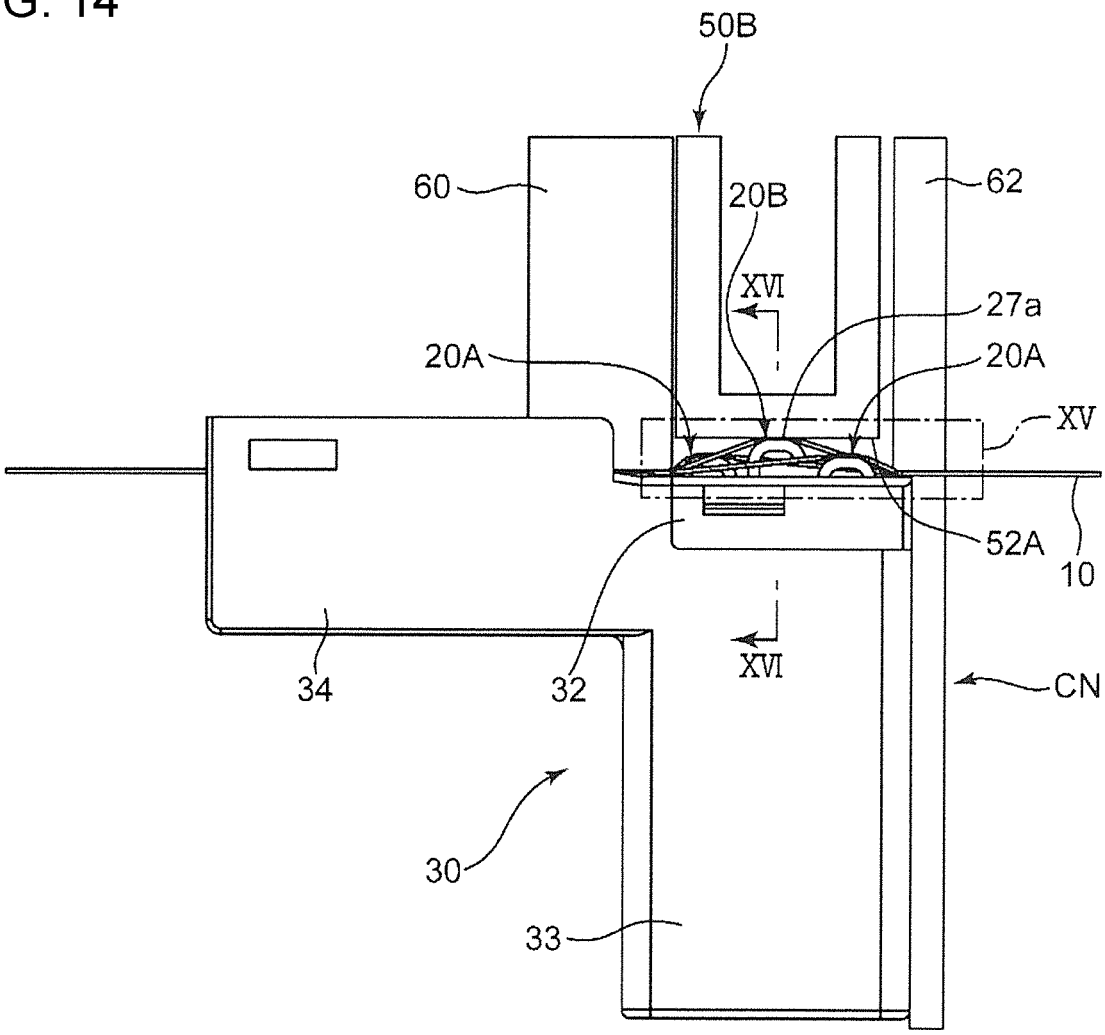
FIG. 14 is a side view showing a step of connecting conductor connection surfaces of second terminals and parts to be connected of the wires corresponding thereto in the method for manufacturing the electrical connection assembly according to the second embodiment of the present invention.
Figure 15:
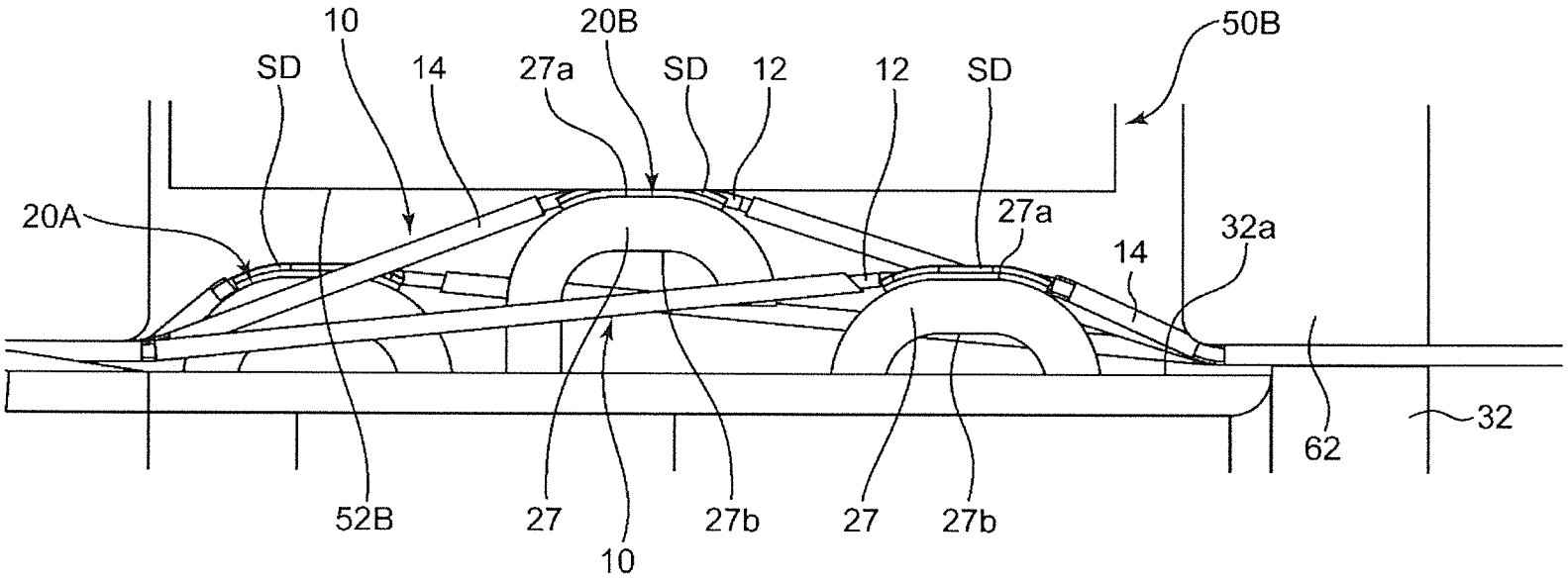
FIG. 15 is an enlarged view of an area enclosed by a frame line XV in FIG. 14.
Figure 16:
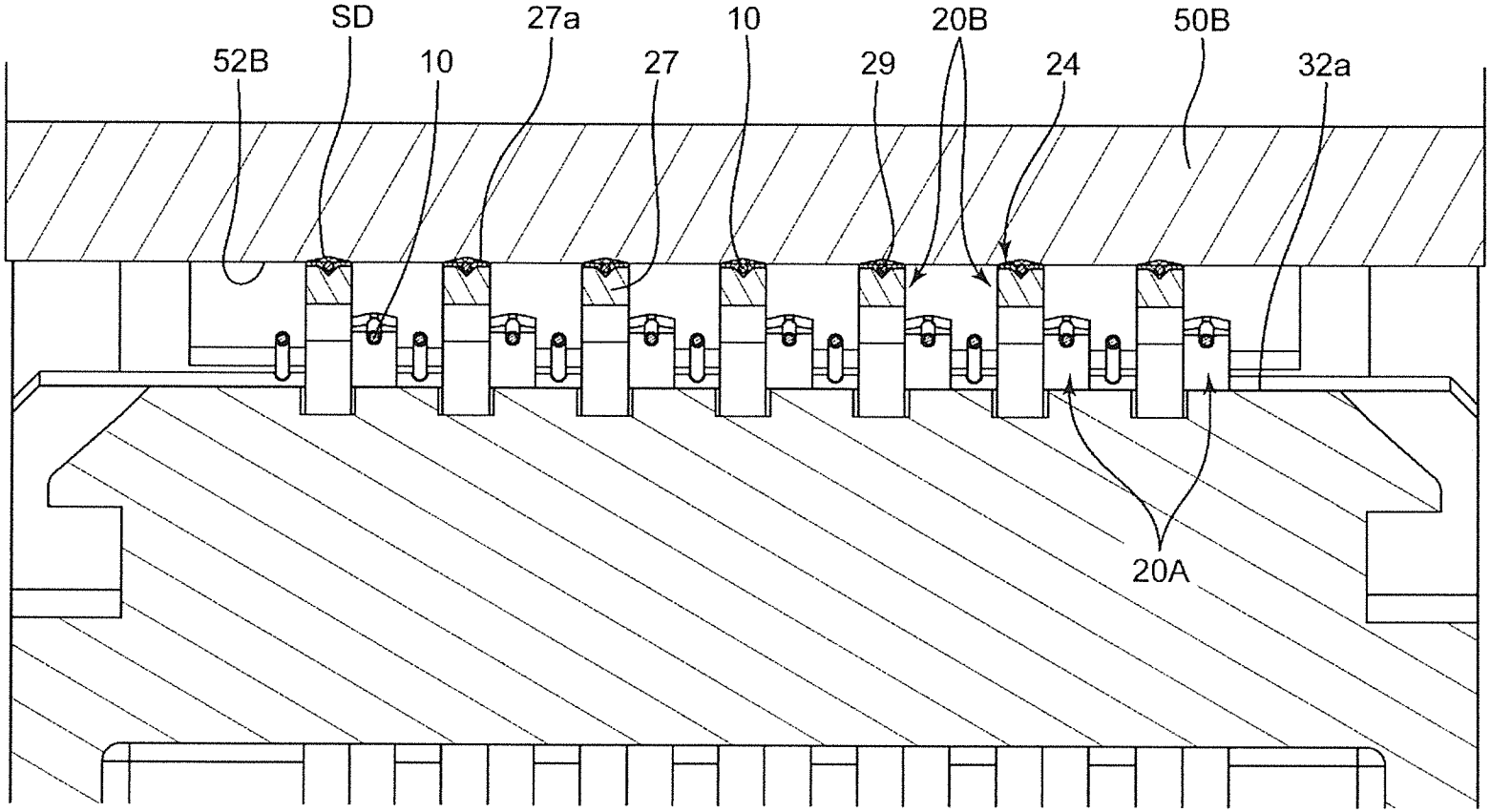
FIG. 16 is a section along XVI-XVI of FIG. 14.

As shown in FIGS. 14 to 16, the second heater 50B has a second heating surface 52B, which is a single heating surface, as in the heater 50 according to the first embodiment. After the connection of the first terminals 20A and the wires 10 is completed as described above, the second heating surface 52B of the second heater 50B is pressed against the conductor connection surfaces 27*a* with the respective wires 10 and the solder SD sandwiched between the second heating surface 52B and the conductor connection surfaces 27*a* in the respective second terminals 20B. In this way, the conductor connection surfaces 27*a* in the second terminals 20B and the parts to be connected of the corresponding conductors 12 are electrically connected by the solder SD, similarly to the first terminals 20A.

Since the second solder connection for the second terminals 20B is performed at the position higher than the conductor connection surfaces 27*a* of the first terminals 20A (at the position more distant from the upper surface 32*a* of the terminal holding portion 32), an influence of heating in the second solder connection on the conductor connection surfaces 27*a* of the first terminals 20A can be suppressed to be small. This can effectively suppress further removal of the insulation coatings 14 of the wires 10 corresponding to the first terminals 20A due to the second heating and prevent the occurrence of a short circuit due to the removal.

Also in the second embodiment, the connecting step preferably includes deforming the wires 10 into an outward convex shape at outward projecting portions 24 of the first and second terminals 20A, 20B by pressing the wires 10 against the upper surface 32*a* of the terminal holding portion 32 at positions on both sides across the outward projecting portions 24. In an example shown in FIGS. 11 to 16, the wires 10 are pressed using dedicated pressing members 60, 62.

The present invention is not limited to the embodiments described above. The present invention includes, for example, the following modes.

A) Concerning Wiring Material

A wiring material used in the present invention is not limited to the one in which the plurality of conductors 12 are respectively individually covered by the insulation coatings 14 to configure the wires 10 as described above. The wiring material may be such that an insulation coating covering respective conductors adjacent to each other in the array direction is an integrally connected insulation coating, e.g. a flat cable or a ribbon cable. Alternatively, a wiring material may be constituted by a plurality of bare wires including no insulation coating.

B) Concerning Third Projecting Portion

Figure 17:
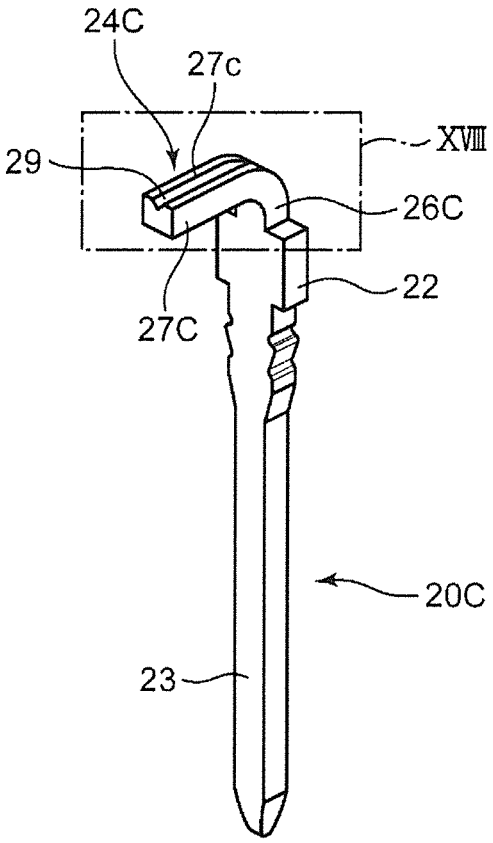
FIG. 17 is a perspective view of a terminal of a connector of an electrical connection assembly according to a third embodiment of the present invention.
Figure 18:
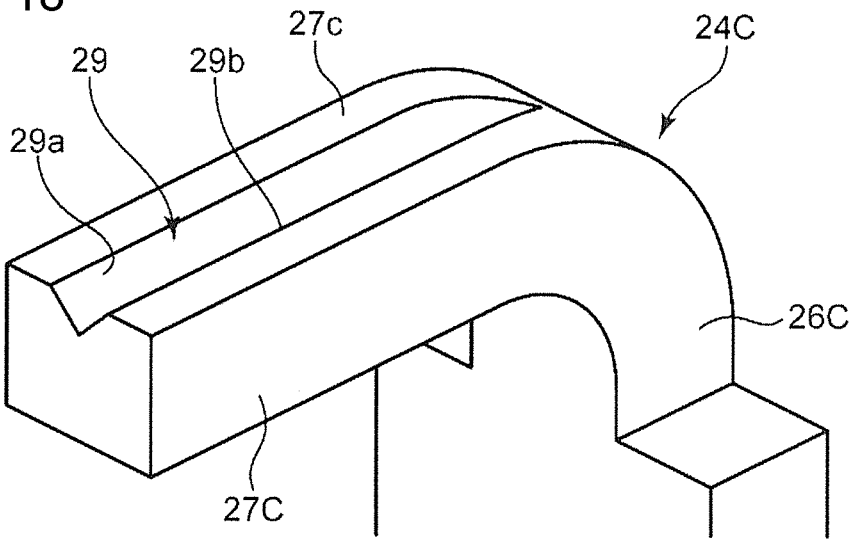
FIG. 18 is an enlarged view of an area enclosed by a frame line XVIII in FIG. 17.

The specific shape of the outward projecting portion of the terminal according to the present invention is not limited. For example, like an outward projecting portion 24C of a terminal 20C shown in FIGS. 17 and 18 as a third embodiment, the outward projecting portion may not include a third projecting portion although including a first projecting portion 26C and a second projecting portion 27C. Also in this case, an outer side surface (surface on a side opposite to the surface of the insulating housing) of the second projecting portion 27C constitutes a conductor connection surface 27*c*, thereby effectively suppressing a short circuit between the conductor connection surfaces 27*c* adjacent to each other. Further, more preferably, the conductor connection surface 27*c* is also formed with a recessed groove 29 for preventing a deviation of a part to be connected as shown in FIGS. 17 and 18.

C) Concerning First and Second Projecting Portions

The first projecting portion according to the present invention only has to project in the specific first direction from the surface of the terminal holding portion (upper surface 32*a* in each of the above embodiments) and may not necessarily be oriented in the first direction at a position distant from the surface. For example, both the first projecting portions 26, 26C according to the first and second embodiments have a bent shape to approach from the first direction to the second direction as extending away from the upper surface 32*a* of the terminal holding portion 32, and the second projecting portions 27, 27C extend in the second direction directly from final ends of the first projecting portions 26, 26C. Conversely, the entire first projecting portion may be oriented in the first direction and the second projecting portion may extend in the second direction from the final end of the first projecting portion. In other words, the shape of the bent part of the outward projecting portion to transition from the first direction to the second direction can be set as appropriate. Alternatively, the outward projecting portion may have such a shape that an intermediate part of a second projecting portion extending in the second direction perpendicular to the first direction is connected to the upper end of a first projecting portion projecting in the first direction, i.e. a so-called T shape.

D) Concerning Connection of Conductor Connection Surfaces and Parts to be Connected Although the removal of the insulation coatings 14 from the surfaces of the conductors 12 by melting or dissolving is performed simultaneously with the melting of the solder by heating using the heater in the first and second embodiments, the insulation coatings 14 may be removed before heating. Specifically, the insulation coatings may be removed in advance before the connecting step by a so-called stripping process to expose the conductors in the parts to be connected set in the plurality of respective wires, and the conductors exposed as described above and the conductor connection surfaces may be directly soldered in the connecting step. In this case, the material constituting the insulation coatings may not necessarily be meltable or dissolvable at the melting temperature of the solder. Further, it goes without saying that the removal of the insulation coatings is not necessary if the wiring material is constituted by a plurality of bare wires.

Further, a specific means for the connection is not limited to soldering. This connection may be made by another connecting means by heating such as welding (laser welding, ultrasonic welding, resistance welding or the like).

E) Concerning Insulating Housing

The insulation housing according to the present invention only has to include a part for holding at least the plurality of terminals (terminal holding portion 32 in the first embodiment). For example, if a plurality of terminals include female electrical contact portions, the receptacle 33 according to the first embodiment or a part equivalent thereto can be omitted.

F) Concerning Cutting Step

The cutting step can be omitted as appropriate. For example, the cutting step may be omitted if the connector CN is connected to an intermediate part of the wiring material (like a connector for branch connection) or if there is no problem even if the wiring material has an extra length after the connecting step. In other words, the parts to be connected in the respective wires in the electrical connection assembly as a product, i.e. parts of the wire to be connected to the conductor connection surfaces of the connector can be arbitrarily set.

As described above, a connector constituting an electrical connection assembly by being connected to a wiring material including a plurality of conductors is provided which enables a width reduction of the electrical connection assembly while avoiding a short circuit between terminals or the conductors adjacent to each other.

Provided is a connector constituting an electrical connection assembly by being connected to a wiring material including a plurality of conductors, the connector including a plurality of terminals respectively corresponding to the plurality of conductors and an insulating housing having a terminal holding portion for collectively holding the plurality of terminals arrayed in an array direction perpendicular to a longitudinal direction of the plurality of conductors to enable the plurality of conductors to be respectively conductively connected to the plurality of terminals while being arranged at intervals in the array direction. Each of the plurality of terminals includes a held portion to be held in the insulating housing and an outward projecting portion projecting outwardly of a surface of the terminal holding portion from the held portion. The outward projecting portion of each of the plurality of terminals has a bent shape to integrally include a first projecting portion projecting in a first direction from the surface of the terminal holding portion and a second projecting portion extending from the first projecting portion in a second direction closer to a direction parallel to the surface of the terminal holding portion than the first direction, and an outer side surface on a side opposite to the surface of the terminal holding portion, out of surfaces of the second projecting portion, has a conductor connection surface shaped to be connectable to the conductor of the wiring material with the wiring material extending in the second direction. The terminal holding portion holds the held portions of the plurality of terminals such that the conductor connection surfaces of the plurality of terminals are arranged at intervals in the array direction.

In this connector, each terminal includes the outward projecting portion projecting outwardly of the surface of the terminal holding portion of the insulating housing, and the outward projecting portion has the bent shape to integrally include the first projecting portion projecting in the first direction from the surface of the terminal holding portion and the second projecting portion extending from the first projecting portion in the second direction closer to the direction parallel to the surface of the terminal holding portion than the first direction, and the outer side surface on the side opposite to the surface of the terminal holding portion, out of the surfaces of the second projecting portion, constitutes the conductor connection surface. Thus, the conductor connection surface can be oriented to extend in the second direction closer to the direction parallel to the surface of the terminal holding portion than the first direction at a position largely spaced in the first direction from the terminal holding portion. Accordingly, the part to be connected of each of the plurality of conductors can be connected along the conductor connection surface in a stable posture without interfering with the terminal holding portion, and a short circuit between the conductors can be effectively suppressed while intervals between the terminals are suppressed to be small.

Specifically, the second projecting portion preferably extends in the second direction at a position where an inner side surface on a side opposite to the outer side surface is spaced outwardly from the surface of the terminal holding portion. The terminal having such a second projecting portion can more reliably avoid a short between this terminal and the terminal adjacent thereto.

The terminal holding portion preferably holds the held portions of the plurality of terminals such that the conductor connection surfaces of the terminals adjacent in the array direction, out of the plurality of terminals, are shifted from each other in a longitudinal direction of the wiring material. This arrangement enables a width reduction of the electrical connection assembly by shortening the intervals between the terminals in the array direction while ensuring a sufficient distance between the terminals adjacent to each other to suppress a short circuit between the terminals.

The plurality of terminals preferably include first terminals having the conductor connection surfaces located at a first height position from the surface of the terminal holding portion of the insulating housing and second terminals adjacent to the first terminals in a direction parallel to the longitudinal direction of the wiring material and having the conductor connection surfaces located at a second height position different from the first height position. It is also very effective in suppressing a short circuit between the conductor connection surfaces to make the heights of the conductor connection surfaces of the first and second terminals adjacent to each other in the direction parallel to the longitudinal direction of the wiring material different from the surface of the terminal holding portion in this way.

On the other hand, the insulating housing preferably further includes a wiring material holding portion extending along a direction parallel to the second direction from the terminal holding portion and configured to hold the wiring material in such a posture as to extend along the second direction. The wiring material holding portion can effectively suppress the action of an excessive force on connected parts of the conductor connection surfaces and the conductors by stabilizing the posture of each conductor to be connected to the conductor connection surface of each terminal.

Further, each of the plurality of terminals may include an electrical contact portion facing a side opposite to the outward projecting portion, extending in a direction parallel to the first direction and fittable to a mating terminal in the direction parallel to the first direction. This terminal can realize both the connection of the terminal and the mating terminal and the connection of the conductor and the terminal while avoiding a short circuit between the conductors although being simply shaped such that the first projecting portion of the outward projecting portion and the electrical contact portion extend in the same direction.

Further, an electrical connection assembly with a wiring material including a plurality of conductors and the above connector is provided in which the plurality of conductors extend along the second direction and are connected to the respective conductor connection surfaces of the plurality of terminals while being arranged at intervals in the array direction perpendicular to the second direction. According to this electrical connection assembly, a width reduction of the entire electrical connection assembly can be realized by suppressing the intervals between the terminals in the array direction to suppress intervals between the conductors adjacent to each other while avoiding a short circuit between the terminals adjacent to each other in the array direction as described above.

The invention claimed is:

1. A connector that is connectable to conductors of a wiring material so that the connector and the wiring material form an electrical connection assembly, the connector comprising:

terminals respectively corresponding to the conductors; and an insulating housing having a terminal holding portion for collectively holding the terminals arrayed in an array direction perpendicular to a longitudinal direction of the conductors to enable the conductors to be connected conductively to the respective terminals while being arranged at intervals in the array direction;

each of the terminals including a held portion held in the insulating housing and an outward projecting portion projecting out from a surface of the terminal holding portion from the held portion;

the outward projecting portion of each of the terminals having a bent shape to integrally include a first projecting portion projecting in a first direction from the surface of the terminal holding portion and a second projecting portion extending from the first projecting portion in a second direction closer to a direction parallel to the surface of the terminal holding portion than the first direction;

an outer side surface on a side opposite to the surface of the terminal holding portion having a conductor connection surface shaped to be connectable to the respective conductor of the wiring material with the wiring material extending in the second direction; and the terminal holding portion holding the held portions of the plurality of terminals such that the conductor connection surfaces of the terminals are arranged at intervals in the array direction, wherein the second projecting portion extends in the second direction at a position where an inner side surface on a side opposite to the outer side surface is spaced outwardly from the surface of the terminal holding portion.

2. A connector of that is connectable to conductors of a wiring material so that the connector and the wiring material form an electrical connection assembly, the connector comprising:

terminals respectively corresponding to the conductors; and an insulating housing having a terminal holding portion for collectively holding the terminals arrayed in an array direction perpendicular to a longitudinal direction of the conductors to enable the conductors to be connected conductively to the respective terminals while being arranged at intervals in the array direction;

each of the terminals including a held portion held in the insulating housing and an outward projecting portion projecting out from a surface of the terminal holding portion from the held portion;

the outward projecting portion of each of the terminals having a bent shape to integrally include a first projecting portion projecting in a first direction from the surface of the terminal holding portion and a second projecting portion extending from the first projecting portion in a second direction closer to a direction parallel to the surface of the terminal holding portion than the first direction;

an outer side surface on a side opposite to the surface of the terminal holding portion having a conductor connection surface shaped to be connectable to the respective conductor of the wiring material with the wiring material extending in the second direction; and the terminal holding portion holding the held portions of the plurality of terminals such that the conductor connection surfaces of the terminals are arranged at intervals in the array direction, wherein the terminal holding portion holds the held portions of the terminals such that the conductor connection surfaces of the terminals adjacent in the array direction are shifted from each other in a longitudinal direction of the wiring material.

3. The connector of claim 2, wherein the second projecting portion extends in the second direction at a position where an inner side surface on a side opposite to the outer side surface is spaced outwardly from the surface of the terminal holding portion.

4. The A connector of claim 1 that is connectable to conductors of a wiring material so that the connector and the wiring material form an electrical connection assembly, the connector comprising:

terminals respectively corresponding to the conductors; and an insulating housing having a terminal holding portion for collectively holding the terminals arrayed in an array direction perpendicular to a longitudinal direction of the conductors to enable the conductors to be connected conductively to the respective terminals while being arranged at intervals in the array direction;

each of the terminals including a held portion held in the insulating housing and an outward projecting portion projecting out from a surface of the terminal holding portion from the held portion;

the outward projecting portion of each of the terminals having a bent shape to integrally include a first projecting portion projecting in a first direction from the surface of the terminal holding portion and a second projecting portion extending from the first projecting portion in a second direction closer to a direction parallel to the surface of the terminal holding portion than the first direction;

an outer side surface on a side opposite to the surface of the terminal holding portion having a conductor connection surface shaped to be connectable to the respective conductor of the wiring material with the wiring material extending in the second direction; and the terminal holding portion holding the held portions of the plurality of terminals such that the conductor connection surfaces of the terminals are arranged at intervals in the array direction, wherein the terminals include first terminals having the conductor connection surfaces located at a first height from the surface of the terminal holding portion and second terminals adjacent to the first terminals in a direction parallel to the longitudinal direction of the wiring material and having the conductor connection surfaces located at a second height different from the first height.

5. The connector of claim 1, wherein the insulating housing further includes a wiring material holding portion extending along a direction parallel to the second direction from the terminal holding portion and configured to hold the wiring material in such a posture as to extend along the second direction.

6. The connector of claim 1, wherein each of the terminals includes an electrical contact portion facing a side opposite to the outward projecting portion, extending in a direction parallel to the first direction and fittable to a mating terminal in the direction parallel to the first direction.

7. An electrical connection assembly, comprising:

a wiring material including conductors; and the connector of claim 1, the conductors extending along the second direction and being connected to the respective conductor connection surfaces of the terminals while being arranged at intervals in the array direction perpendicular to the second direction.

* * * * *